US008198559B2

(12) United States Patent
Sato

(10) Patent No.: US 8,198,559 B2
(45) Date of Patent: Jun. 12, 2012

(54) ILLUMINATED PUSH BUTTON SWITCH

(75) Inventor: Takashi Sato, Miyagi-Ken (JP)

(73) Assignee: Alps Electric Co., Ltd., Tokyo (JP)

( * ) Notice: Subject to any disclaimer, the term of this patent is extended or adjusted under 35 U.S.C. 154(b) by 341 days.

(21) Appl. No.: 12/535,412

(22) Filed: Aug. 4, 2009

(65) Prior Publication Data

US 2010/0038224 A1 Feb. 18, 2010

(30) Foreign Application Priority Data

Aug. 14, 2008 (JP) ..... 2008-208968

(51) Int. Cl.
*H01H 9/00* (2006.01)

(52) U.S. Cl. ..... 200/314

(58) Field of Classification Search ..... 200/310, 200/313, 314, 317, 341, 345, 51.16, 520, 200/5 E See application file for complete search history.

(56) References Cited

U.S. PATENT DOCUMENTS

| | | | |
|---|---|---|---|
| 2003/0042121 | A1 | 3/2003 | Hirahata et al. |
| 2005/0274593 | A1 | 12/2005 | Kawano |

FOREIGN PATENT DOCUMENTS

| | | | |
|---|---|---|---|
| FR | 2857501 | A1 | 7/2003 |
| JP | 61-107118 | | 7/1986 |
| JP | 2974397 | | 9/1999 |
| JP | 2000-182465 | | 6/2000 |
| JP | 2004-134274 | | 4/2004 |
| JP | 2004-206944 | | 7/2004 |
| JP | 4080322 | | 2/2008 |
| WO | WO 2007/148902 | A1 | 12/2007 |

OTHER PUBLICATIONS

Extended European Search Report issued in corresponding European Patent Application No. 09010247.6, mailed Aug. 30, 2010.

*Primary Examiner* — Vanessa Girardi
(74) *Attorney, Agent, or Firm* — Brinks Hofer Gilson & Lione

(57) ABSTRACT

An illuminated push button switch includes a manipulation knob, a hollow slider, a casing, which vertically guides the slider, a switch element, which is operated by the vertical movement of the slider, and a light source. A front end portion of the slider protrudes forward from the casing. The manipulation knob includes: a body; a skirt portion, which protrudes backward from a peripheral edge of the body and surrounds the front end portion of the slider; connection pieces protruding backward from a rear surface of the body more than the skirt portion and inserted into the slider; and locking holes provided in the connection piece. An inner wall surface of the slider is provided with locking claws which are snapped into the locking holes of the connection pieces so that the manipulation knob is snap-connected to the slider.

3 Claims, 2 Drawing Sheets

ILLUMINATED PUSH BUTTON SWITCH

The present invention claims the benefit of Japanese Patent Application JP 2008-208968 filed in the Japanese Patent Office on Aug. 14, 2008, the entire contents of which is incorporated herein by reference.

BACKGROUND

1. Technical Field

The present invention relates to an illumination switch device, which illuminates an illumination portion formed in a manipulation surface of a manipulation knob by using light of a light source.

2. Related Art

In an in-car switch device, which is used to perform an on-off switching operation by an operation of pushing a manipulation knob, an illumination mechanism is provided, which is capable of illuminating an illumination portion formed in a manipulation surface of the manipulation knob by using light of an embedded light source in order to ensure the visualizing ability in a dark place such as a tunnel or at night. As an example of the illumination switch device, there is known an illumination switch device having a structure shown in FIG. 2 (for example, see Japanese Patent No. 4080322).

As shown in FIG. 2, the known illumination switch device includes a manipulation knob 11, which has an illumination portion 10 formed in the upper surface thereof, a hollow slider 12, which is incorporated into the manipulation knob 11, a casing 13, which elevatably guides the slider 12, a print circuit board 14, which is disposed inside the casing 13, a push switch (switch element) 15, which is mounted on the print circuit board 14, an LED (Light Emitting Diode) 16, which serves as a light source and is mounted on the print circuit board 14, where the LED 16 is disposed right below a hollow portion of the slider 12. The manipulation knob 11 includes a body 17, which is formed of a light transmitting resin and a light shielding coating material 18, which is coated on the outer surface thereof. The illumination portion 10 is formed by removing a part of the light shielding coating material 18 from the upper surface of the body 17 so as to have a desired shape. The peripheral edge portions of the manipulation knob 11 are respectively formed as skirt portions 11*a* protruding downward, and both facing side walls of the skirt portions 11*a* are respectively provided with locking holes 11*b*. In addition, each locking hole 11*b* is formed through each skirt portion 11*a*. The slider 12 is formed of a light shielding resin, and the upper outer surface thereof is provided with a pair of locking claws 12*a*. Then, when the manipulation knob 11 is disposed so as to cover the upper portion of the slider 12 and the locking holes 11*b* are respectively inserted and snap-connected to the corresponding locking claws 12*a*, the manipulation knob 11 is incorporated into the slider 12. In addition, the slider 12 can elevate via a guide hole 13*a* as a sliding surface of the casing 13, and the upper portion of the slider 12 including the snap-connected portion of the manipulation knob 11 protrudes upward from the guide hole 13*a*. Further, a stem 15*a* of a push switch 15 comes into contact with the lower end portion of the slider 12, and the slider 12 is urged upward by an elastic repellent force of a returning spring (not shown) provided inside the push switch 15.

In the illumination switch device with such a configuration, when the body 17 of the manipulation knob 11 is formed of, for example, a creamy white light transmitting resin, and the black light shielding coating material 18 is coated on the outer surface thereof except for the illumination portion 10, it is possible to see the illumination portion 10, which is seen as creamy white over black in a bright place. On the other hand, when the LED 16 is turned on in a dark place or at night, light of the LED 16 is irradiated to the rear surface of the manipulation knob 11 via the inner space of the slider 12 so as to reach the illumination portion 10 via the body 17 as shown by the arrow A in FIG. 2. Accordingly, it is possible to see the illumination portion 10 illuminated as creamy white in a dark place.

However, in the known illumination switch device, each locking hole 11*b* snap-connected to each locking claw 12*a* of the slider 12 is formed in the skirt portion 11*a* of the manipulation knob 11. For this reason, a problem arises in that the light of the LED 16 reaches the locking hole 11*b* via the inside of the body 17 during the illumination operation and the light leaks from a ceiling surface of the locking hole 11*b* to the outside of the manipulation knob 11 as shown by the arrow B in FIG. 2.

In addition, a structure shown in FIG. 3 can be considered as solving means for preventing the optical leakage. In detail, the rear surface of the manipulation knob 11 is provided with a pair of connection pieces 11*c*, which protrudes backward, and the locking holes 11*b* provided in the connection pieces 11*c* are respectively snap-connected to the locking claws 12*a* formed in the outer surface of the slider 12. In this case, if the locking hole 11*b* is formed in the connection piece 11*c* at a position completely covered by the skirt portion 11*a* of the manipulation knob 11, that is, a position above the lower end portion of the skirt portion 11*a*, it is possible to shield the light leaking from the locking hole 11*b* to the outside of the manipulation knob 11 by using the skirt portion 11*a*. However, the locking claw 12*a* is required to be formed at a position below the lower end portion of the skirt portion 11*a* due to a limitation in a structure of a mold, and the locking hole 11*b* is located above the casing 13 so as to be exposed to the outside. For this reason, it is not possible to sufficiently prevent the light from leaking from the locking hole 11*b*. In addition, the slider 12 incorporated into the manipulation knob 11 is elevated by being guided via the guide hole 13*a* of the casing 13. Since the outer surface of the slider 12 is snap-connected to the connection piece 11*c* of the manipulation knob 11, when the slider 12 moves down via the guide hole 13*a*, the slider 12 cannot move down any more at the time point when the lower end portion of the connection piece 11*c* collides with the upper surface of the casing 13. As a result, the slider 12 is largely limited by the connection piece 11*c* having a long guide length, and for example, the push switch 15 having an extremely short stroke length is required to be used, thereby causing a problem in that a degree of freedom in design deteriorates.

SUMMARY

An illumination switch device includes: a manipulation knob in which a light shielding portion is provided in a front outer surface of a body formed of a light transmitting material except for an illumination portion; hollow sliders, each of which is incorporated into the manipulation knob and is formed of a light shielding material; a casing, which elevatably guides the slider; a switch element, which is operated by the elevation movement of the slider; and a light source, which irradiates light to a rear surface of the manipulation knob via an inner space of the slider. A front end portion of the slider is disposed so as to protrude forward from the casing and the manipulation knob is snap-connected to the front end portion of the slider protruding from the casing. The manipulation knob includes: a skirt portion, which protrudes backward from a peripheral edge portion of the body so as to surround the front end portion of the slider; a connection piece, which protrudes backward from a rear surface of the body more than the skirt portion so as to be inserted into the slider; and a locking hole, which is provided in the connection piece so as to be located on the lower side of the skirt portion. An inner wall surface of the slider is provided with a locking claw, which is snap-connected to the locking hole.

In the illumination switch device with such a configuration, since the locking hole is located on the lower side of the skirt portion, it is possible to easily form the locking hole. Also, the locking hole is formed in the connection piece protruding from the rear surface of the body of the manipulation knob, the inner wall surface of the hollow slider is provided with the locking claw, and then the connection piece is inserted into the slider so that the locking claw is snap-connected to the locking hole. For this reason, even when the light irradiated to the rear surface of the manipulation knob reaches the locking hole via the inside of the body during the illumination operation, the light is shielded by the peripheral wall of the hollow slider surrounding the connection piece and formed of a light shielding material, thereby reliably preventing the light from leaking from the locking hole to the outside. In addition, the connection piece of the manipulation knob is snap-connected to the inner wall surface of the slider, and the elevation amount (stroke length) of the slider is not influenced by the length of the connection piece. Accordingly, even when the connection piece protrudes more than the skirt portion of the manipulation knob and the locking hole is formed in the protruding portion, it is possible to sufficiently ensure the guide length of the casing with respect to the slider.

DESCRIPTION OF EXEMPLARY EMBODIMENTS

Figure 1:
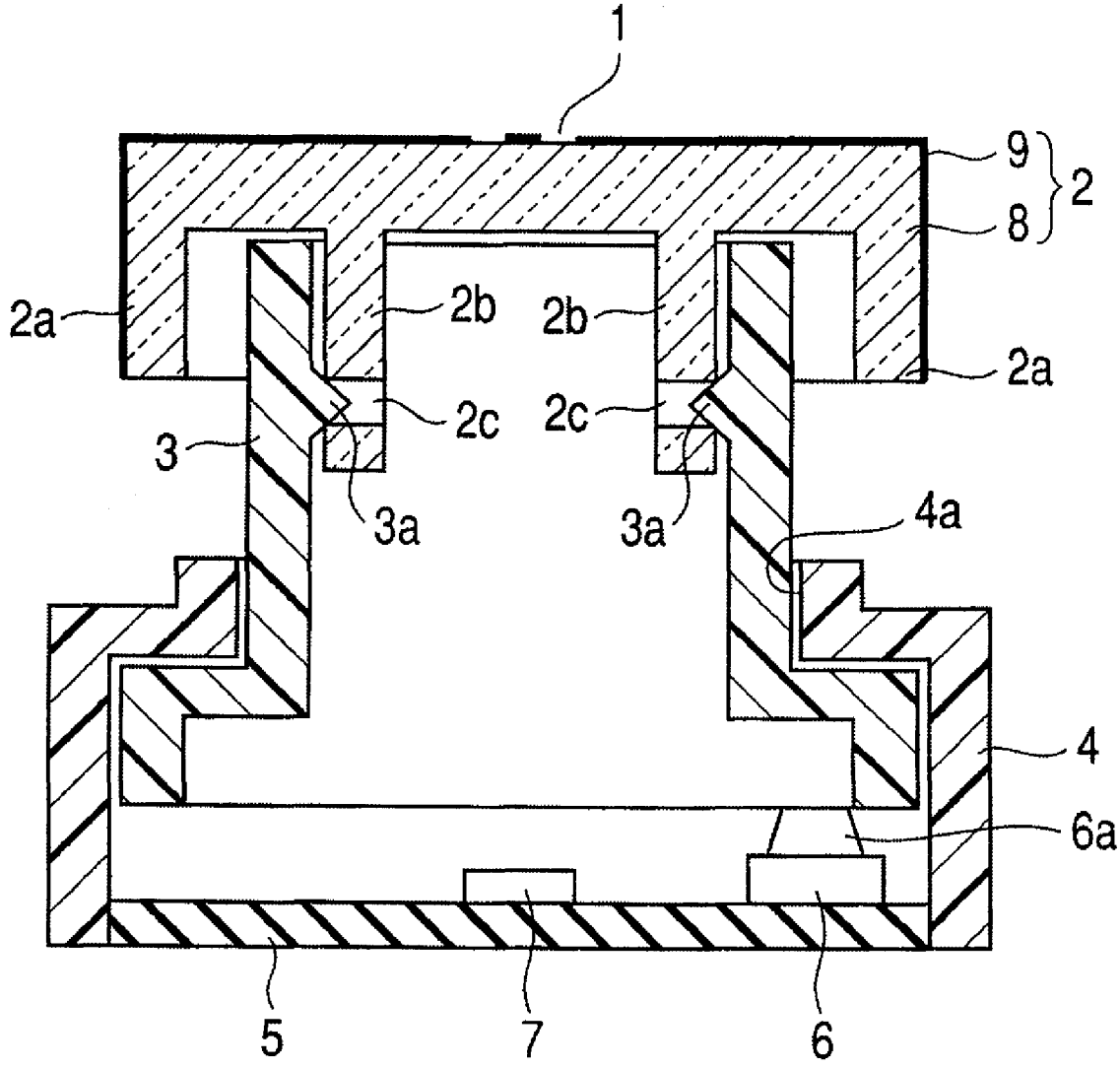
FIG. 1 is a cross-sectional view showing an illumination switch device according to an embodiment of the invention.
Figure 2:
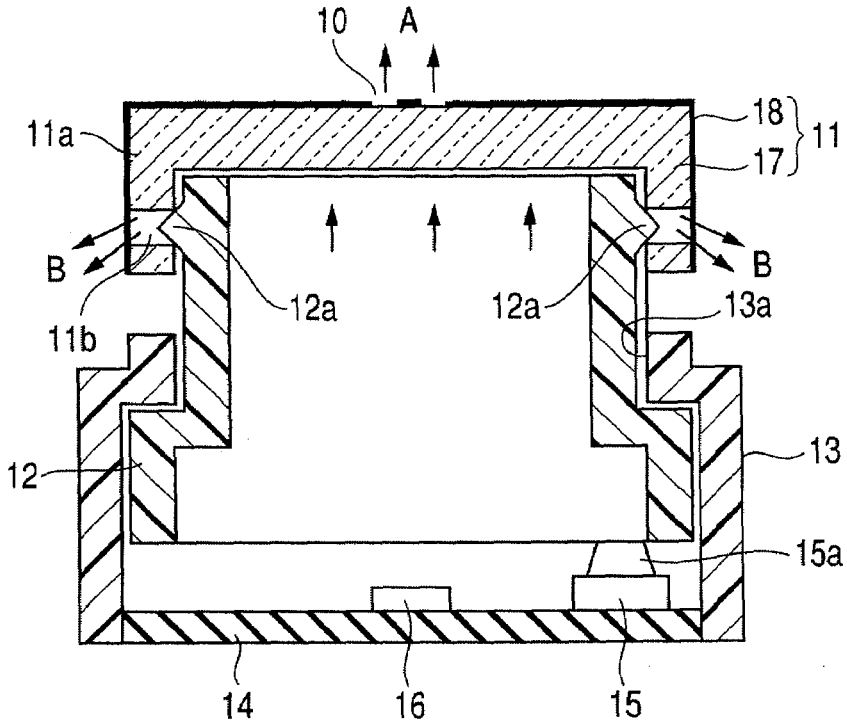
FIG. 2 PRIOR ART
FIG. 2 is a cross-sectional view showing an illumination switch device according to a known example.
Figure 3:
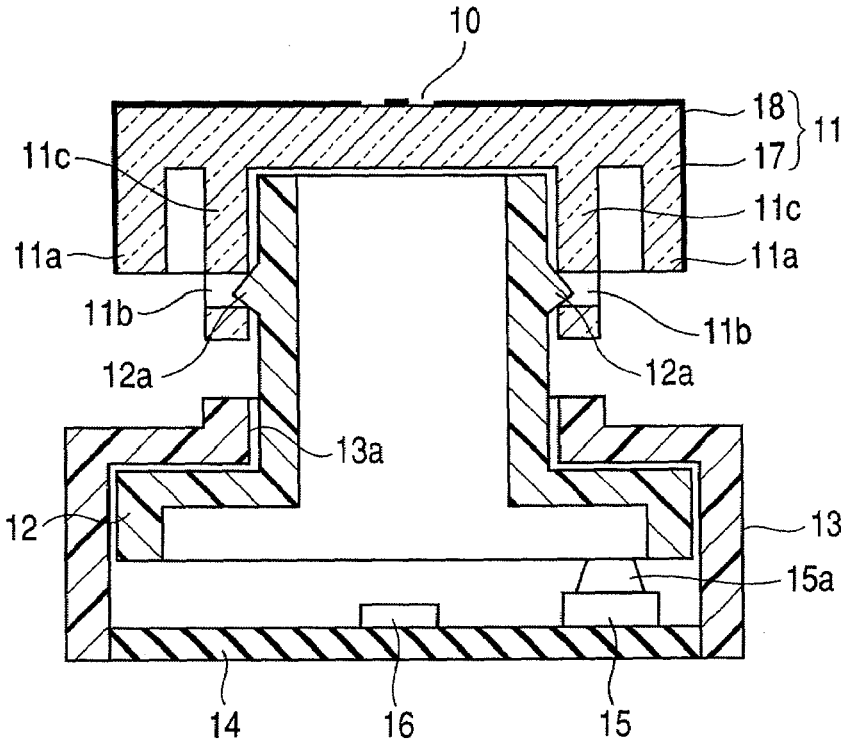
FIG. 3 is a cross-sectional view showing an illumination switch device according to an exemplary embodiment.

An exemplary embodiment of the invention will be described with reference to the accompanying drawings. FIG. 1 is a cross-sectional view showing an illumination switch device according to an embodiment of the invention. In addition, in the description, the upside of FIG. 1 corresponds to the forward and upward directions, and the downside of FIG. 1 corresponds to the backward and downward directions in the specification.

As shown in FIG. 1, an illumination switch device, according to the embodiment includes a manipulation knob 2, which has an illumination portion 1 formed in the upper surface thereof, a hollow slider 3, which is incorporated into the manipulation knob 2, a casing 4, which elevatably guides the slider 3, a print circuit board 5, which is disposed inside the casing 4, a push switch (switch element) 6, which is mounted on the print circuit board 5, and an LED (light source) 7, which is mounted on the print circuit board 5.

The manipulation knob 2 includes a body 8, which is formed of, for example, a creamy white light transmitting resin and, for example, a black light shielding coating material 9, which is coated on the front outer surface of the body 8. Since the illumination portion 1 is formed by removing a part of the light shielding coating material 9 from the upper surface of the body 8 so as to have a desired shape, it is possible to see the illumination portion 1, which is seen as creamy white over black in a bright place. A skirt portion 2*a* is integrally formed with the peripheral edge portion of the body 8 of the manipulation knob 2, and the skirt portion 2*a* protrudes backward and surrounds the front end portion (upper portion) of the slider 3. In addition, a pair of connection pieces 2*b* is integrally formed with the rear surface of the body 8, and the connection pieces 2*b* protrude backward more than the skirt portion 2*a* so as to be inserted into the slider 3. The lower end portion of each connection piece 2*b* is provided with a locking hole 2*c*. Since the formation position of the locking hole 2*c* is set to the lower side of the skirt portion 2*a*, it is possible to form the body 8 of the manipulation knob 2 by using a slide-core-type mold. In addition, the locking hole 2*c* is formed through the connection piece 2*b*.

The slider 3 is formed of, for example, a black light shielding resin, and both facing inner walls thereof are provided with a pair of locking claws 3*a*. Then, the manipulation knob 2 is disposed so as to cover the upper portion of the slider 3, both connection pieces 2*b* are inserted into the slider 3, and then the locking holes 2*c* are snap-connected to the corresponding locking claws 3*a*, thereby incorporating the manipulation knob 2 into the slider 3. The slider 3 can be elevated via a guide hole 4*a* as a sliding surface of the casing 4, and the upper portion of the slider 3 including the snap-connection portion of the manipulation knob 2 protrudes upward from the guide hole 4*a*. In addition, a stem 6*a* of the push switch 6 comes into contact with the lower end portion of the slider 3 inside the casing 4, and the slider 3 is urged upward by an elastic repellent force of a returning spring (not shown) provided inside the push switch 6. Further, the LED 7 is disposed right below the hollow portion of the slider 3, and light of the LED 7 is irradiated to the rear surface of the manipulation knob 2 via the inner space of the slider 3.

In the illumination switch device with such a configuration, when a user pushes the manipulation knob 2, the slider 3 incorporated into the manipulation knob 2 moves down by being guided by the guide hole 4*a* of the casing 4, and the stem 6*a* of the push switch 6 is pushed by the slider 3 to be turned on. In addition, when the pushing force applied to the manipulation knob 2 is removed, the slider 3 moves up by the elastic repellent force of the returning spring (not shown) provided inside the push switch 6, and hence the manipulation knob 2 and the slider 3 automatically return to the initial positions, respectively.

Here, when the LED 7 is turned on in a dark place or at night, the light of the LED 7 is irradiated to the rear surface of the manipulation knob 2 via the inner space of the slider 3, and the light reaches the illumination portion 1 via the body 8, thereby seeing the illumination portion 1 illuminated as creamy white in a dark place. At this time, even when the light irradiated to the rear surface of the manipulation knob 2 returns to the inside of the body 8 and reaches the locking hole 2*c*, the light is shielded by the light shielding slider 3 surrounding the connection piece 2*b*, thereby reliably preventing the light of the LED 7 from leaking from the locking hole 2*c* to the outside of the manipulation knob 2. In addition, the connection piece 2*b* of the manipulation knob 2 is longer than the skirt portion 2*a* due to the limitation in the structure of the mold. However, when the slider 3 moves down via the guide hole 4*a* of the casing 4, the connection piece 2*b* moves down together with the slider 3 without colliding with the casing 4. This is because the locking hole 2*c* formed in the connection piece 2*b* is snap-connected to the locking claw 3*a* inside the slider 3. As a result, since the elevation amount (stroke length) of the slider 3 is not limited by the length of the connection piece 2*b*, it is possible to sufficiently ensure the guide length of the casing 4 with respect to the slider 3.

Further, in the above-described embodiment, the LED 7 is used as the light source for illuminating the illumination portion 1 of the manipulation knob 2, but other light sources such as a lamp may be used.

It should be understood by those skilled in the art that various modifications, combinations, sub-combinations and alterations may occur depending on design requirements and other factors insofar as they are within the scope of the appended claims of the equivalents thereof.

What is claimed is:

1. An illumination switch device comprising:

a manipulation knob in which a light shielding portion is provided in a front outer surface of a body formed of a light transmitting material except for an illumination portion;

a hollow slider, which is incorporated into the manipulation knob and is formed of a light shielding material;

a casing, which vertically guides the slider;

a switch element, which is operated by the vertical movement of the slider; and a light source, which irradiates light to a rear surface of the manipulation knob via an inner space of the slider, wherein a front end portion of the slider is disposed so as to protrude forward from the casing and the manipulation knob is snap-connected to the front end portion of the slider protruding from the casing, wherein the manipulation knob includes:

a skirt portion, which protrudes backward from a peripheral edge portion of the body so as to surround the front end portion of the slider;

a connection piece, which protrudes backward from a rear surface of the body more than the skirt portion so as to be inserted into the slider; and a locking hole, which is provided in the connection piece so as to be located on a lower side of the skirt portion, and wherein a locking claw is provided on an inner wall surface of the slider and is snap-connected to the locking hole.

2. The illumination switch device according to claim 1, comprising a pair of connection pieces, wherein a front end portion of each connection piece is provided with the locking hole, and wherein inner wall surfaces of the slider that face the locking holes are respectively provided with the locking claws, which are respectively snap-connected to the locking holes.

3. The illumination switch device according to claim 1, wherein a hollow portion of the slider is disposed so as to face the illumination portion of the manipulation knob, and the locking hole is formed through the connection piece.

* * * * *